US007378797B2

(12) United States Patent
Karrs et al.

(10) Patent No.: US 7,378,797 B2
(45) Date of Patent: May 27, 2008

(54) FLUORESCENT LAMP WITH CONDUCTIVE COATING

(75) Inventors: Evan Karrs, Gibsonia, PA (US); William W. Beers, Chesterland, OH (US); Matthew Pierce, Cleveland Heights, OH (US); Gary R. Allen, Chesterland, OH (US)

(73) Assignee: General Electric Company, Schenectady, NY (US)

( * ) Notice: Subject to any disclaimer, the term of this patent is extended or adjusted under 35 U.S.C. 154(b) by 38 days.

(21) Appl. No.: 11/303,149

(22) Filed: Dec. 16, 2005

(65) Prior Publication Data

US 2007/0138960 A1 Jun. 21, 2007

(51) Int. Cl.
*H01J 11/00* (2006.01)

(52) U.S. Cl. ..... 313/607; 313/234; 313/261

(58) Field of Classification Search ..... 313/607, 313/234; 315/261

See application file for complete search history.

(56) References Cited

U.S. PATENT DOCUMENTS

| | | | | |
|---|---|---|---|---|
| 3,067,356 | A | | 12/1962 | Ray |
| 3,624,444 | A | | 11/1971 | Berthold et al. |
| 3,717,781 | A | | 2/1973 | Sadoski et al. |
| 3,809,944 | A | | 5/1974 | Jongerius et al. |
| 3,932,783 | A | | 1/1976 | Menelly et al. |
| 3,963,954 | A | | 6/1976 | Milke et al. |
| 3,967,153 | A | | 6/1976 | Milke et al. |
| 4,020,385 | A | | 4/1977 | Lagos |
| 4,360,761 | A | | 11/1982 | Roche |
| 4,468,591 | A | * | 8/1984 | Hammer et al. ..... 313/594 |
| 4,500,810 | A | | 2/1985 | Graff |
| 4,568,859 | A | | 2/1986 | Houkes et al. |
| 4,701,667 | A | * | 10/1987 | Cinalli ..... 313/594 |
| 4,754,199 | A | * | 6/1988 | Parker ..... 315/85 |
| 5,382,879 | A | * | 1/1995 | Council et al. ..... 315/248 |
| 5,583,394 | A | * | 12/1996 | Burbank et al. ..... 313/498 |
| 5,668,443 | A | * | 9/1997 | Kawaguchi et al. ..... 315/169.1 |
| 5,702,179 | A | | 12/1997 | Sidwell et al. |
| 5,877,589 | A | * | 3/1999 | Morgan et al. ..... 313/582 |
| 5,929,564 | A | * | 7/1999 | Nakaya et al. ..... 313/607 |
| 6,388,394 | B1 | * | 5/2002 | Mita et al. ..... 315/291 |
| 7,053,553 | B1 | * | 5/2006 | Fulop et al. ..... 313/594 |
| 2005/0118454 | A1 | * | 6/2005 | Nakaya et al. ..... 428/690 |
| 2005/0179358 | A1 | * | 8/2005 | Soules et al. ..... 313/487 |

* cited by examiner

*Primary Examiner*—Vip Patel
(74) *Attorney, Agent, or Firm*—Pearne & Gordon LLP

(57) ABSTRACT

Fluorescent lamps that comprise a glass envelope with an exterior surface and first and second electrodes located within the glass envelope include a transparent electrically conductive material affixed to the exterior surface of the glass envelope. The transparent electrically conductive material extends between the vicinity of the first electrode and the vicinity of the second electrode, thereby providing a path for an electric current to pass between the first and second electrodes and reduce the open circuit voltage required to start the fluorescent lamp. The transparent electrically conductive material affixed to the exterior surface of the glass envelope can comprise one or more stripes of the material so that less than the total exterior surface area of the glass envelope is covered by the transparent electrically conductive material.

22 Claims, 2 Drawing Sheets

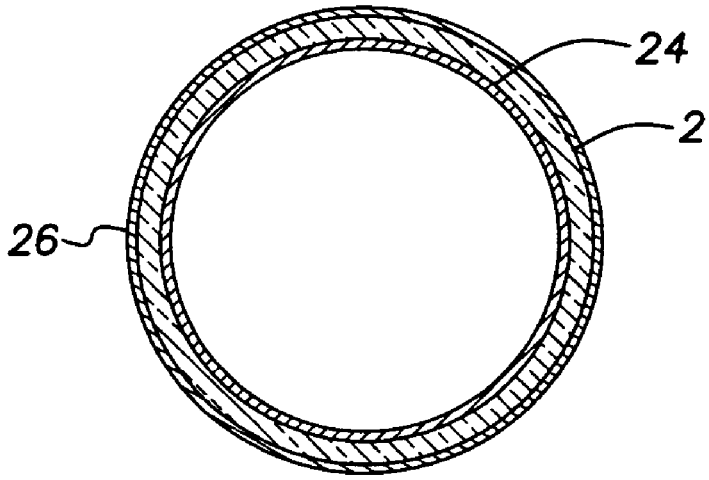
FIG. 3
FIG. 4
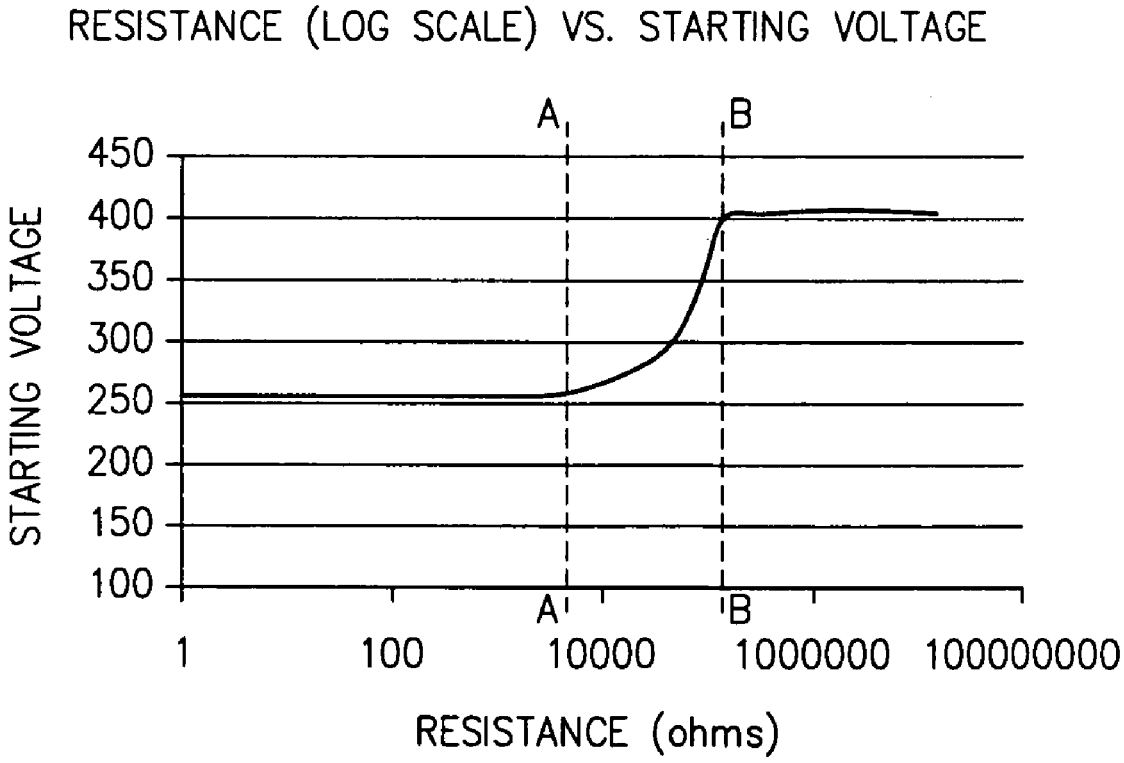

FLUORESCENT LAMP WITH CONDUCTIVE COATING

BACKGROUND OF THE INVENTION

The present invention relates in general to fluorescent lamps and in particular to fluorescent lamps the glass envelopes of which include a transparent electrically conductive material that serves to reduce the open circuit voltage required to start the fluorescent lamps.

The operation of fluorescent lamps is well understood by those skilled in the art, but certain salient features of the operation are reviewed here for the purposes of facilitating a better appreciation of the benefits of the present invention.

A fluorescent lamp typically comprises a sealed glass envelope, usually in the form of a glass tube, that contains a small amount of mercury and an inert gas under low pressure. Examples of inert gases that can be used are argon, krypton, neon, xenon and mixtures thereof. The inside surface of the glass envelope is coated with a phosphor powder. Two electrodes are located within the glass envelope and are wired to an electric circuit that is connected to an alternating current supply.

When the fluorescent lamp is turned on, electric current flows through the electric circuit causing electrons to be emitted from the electrodes. The electrons then flow through the interior of the glass envelope along an electrical field applied between the two electrodes. In the meantime, at least a portion of the liquid mercury is vaporized to mercury gas within the glass envelope, and the electrons ionize the mercury gas. This increases the conductivity of the inert gas so that more electric current can flow and more power thereby dissipated in the inert gas. The power so provided converts additional liquid mercury into a gas until a near-optimal pressure of mercury vapor has been established by the evaporation of the liquid mercury. As electrons and mercury ions move through the interior of the glass envelope, the electrons collide with the gaseous mercury atoms. As a result, the energy level of the outermost electron in some of the gaseous mercury atoms is raised. When these electrons return to their original energy levels, photons are radiated.

Most of the photons radiated by the gaseous mercury atoms are in the ultraviolet wavelength range and are not visible to the naked eye. However, when one of the ultraviolet photons strikes the phosphor powder that coats the inside surface of the glass envelope, one of the phosphor atom's electrons is excited to a higher energy level. When the electron in the phosphor atom returns to its normal energy level, it radiates energy in the form of another photon. The wavelength of this photon is in the visible spectrum and can be seen by the naked eye.

Before the lamp is turned on, there are a very few ions and electrons present in the gas within the glass envelope. Consequently, it is difficult to pass an electric current from one electrode to the other and establish an electric arc between the electrodes capable of sustaining the generation of white light within the glass envelope. Therefore, it is necessary to initially provide a high enough voltage across the electrodes to generate a sufficient density of free electrons in the gas within the glass envelope such that the gas becomes an electrically conductive medium. Once that is accomplished, the current across the electrodes increases to a level capable of establishing the electric arc required for normal lamp operation. The desired voltage and operating current are provided and controlled by a ballast that is incorporated into the electric circuit to which the lamp is wired. The voltage across the electrodes required for the lamp to ignite and transition to arc is variously referred to as the ignition voltage and starting voltage. The voltage that is supplied to the ballast during lamp ignition is usually referred to as the open circuit voltage. It is generally desired for design simplicity and the cost of the ballast that the ignition voltage required to start the lamp be as low as possible.

The operation of ballasts are well known to those skilled in art, and the details of their operation are not presented here. However, it is noted that with a so-called rapid-start type of ballast a heating current continually flows through both electrodes while the ignition voltage is applied between the two electrodes. When the fluorescent lamp is turned on, the voltage that is applied must exceed the ignition voltage that is required to ionize the gas in the glass envelope so that the electric arc current can be established. After the ballast is switched on, the filaments of both electrodes heat up very quickly (due to the heating current), thereby thermionically emitting the electrons required to sustain the operating current of the lamp without unduly damaging the electrodes. A related type of ballast, known as a programmed-start ballast, provides a similar heating current to the electrodes during ignition, and for a few seconds thereafter, until the electrodes have reached the temperature necessary for the thermionic emission of electrons required to establish and supply the electric arc. Thereafter, the heating current is terminated to save the portion of power supplied to the lamp for heating and the electrodes are self-heated by both the lamp current and thermal contact with the discharge. Both rapid-start and programmed-start ballasts are advantageous for long lamp life because, during start-up and warm-up of the lamp, most of the electrons supplied by the electrodes are from thermionic emission as opposed to a more destructive process.

Another type of ballast that is used with fluorescent lamps is the so-called instant-start ballast. This type of ballast applies a somewhat higher voltage across the electrodes than a rapid-start ballast but does not simultaneously heat the electrodes. The electrons required by the electric arc during ignition and briefly thereafter are primarily emitted from the electrodes by a damaging process of secondary electron emission. This emission is driven by bombardment of the electrode with high energy ions. The high energy ions not only eject electrons from the cold electrodes but they also sputter the emission mix and the tungsten metal from the electrodes, typically resulting in reduced lamp life. Consequently, to achieve the longest possible lamp life, it is desirable to enable all lamps to start on rapid-start and programmed-start ballasts which provide a lower circuit voltage than the instant-start ballasts.

There can be instances where fluorescent lamps, for various reasons, are difficult to start or transition to arc. For example, the ballast available in a particular instance may not be capable of generating an open circuit voltage that exceeds the ignition voltage required for the lamp to ignite.

Standard fluorescent lamps utilizing only argon as the inert gas filler have a lower lumen efficacy, expressed as lumens per watt, as compared to mixed argon/krypton energy-efficient, lower wattage fluorescent lamps. These lower wattage lamps yield reduced positive column power through substitution of some or all of the argon fill gas by krypton, or possibly xenon. The addition of krypton reduces energy consumption in fluorescent lamps because krypton has a higher atomic weight than argon resulting in a lower voltage gradient in the positive column with lower heat conduction losses per unit length of discharge in the lamp.

Lamps of this type are often referred to as watt-miser lamps. The addition of krypton increases the open circuit voltage required to start the lamp so that the lamp will not start with some ballasts including many rapid-start and programmed-start ballasts. For example, a standard full-argon F32T8 lamp of the General Electric Company requires an open circuit voltage of approximately 300 to 315 volts to ignite while an argon-krypton F32T8WM watt-miser fluorescent lamp of the General Electric Corporation may require an open circuit voltage of more than about 400 volts to transition to arc. In these lamp designations, "F" means fluorescent, "32" means 32 watts dissipated in the lamp, "T8" means a lamp having a diameter of eight one-eighths of an inch, or one inch, and "WM" means "watt-miser". The energy-saving argon-krypton lamps provided by manufacturers other than the General Electric Company have similar identifying nomenclature.

If the watt-miser fluorescent lamps are used with the instant-start ballasts described above that are capable of providing open circuit voltages in excess of about 400 volts, the watt-miser lamps normally will not experience any difficulty in igniting. However, if the watt-miser fluorescent lamps are paired with the rapid-start or programmed-start ballasts described above, that are only capable of providing open circuit voltages of less than 400 volts, (but which typically provide for longer lamp life) the watt-miser fluorescent lamps may not ignite. It would be desirable to have watt-miser fluorescent lamps available that, in general, start and transition to arc for rapid-start and programmed-start ballasts as well as for instant-start ballasts. And in particular, it would be desirable to have available a high-efficiency lamp containing krypton capable of starting and operating on all existing ballasts so that the lamps can be rated for "Universal Operation On All Ballasts".

Certain of the foregoing concerns have been addressed in the prior art by the provision of a starting assembly or starting aid that effects starting of fluorescent lamps with or without krypton in the fill gas. The starting assembly provides an easier path for the electrons to flow along during start-up of the lamps, thereby reducing the peak starting voltage requirement of the lamps.

One conventional starting aid consists of a metal strip attached to the outside of the glass envelope of the lamp. In a typical embodiment, an optically-opaque electrically-conducting metal strip is applied to the outside of the glass envelope of a lamp having a diameter of about one and one-half inches. The strip is approximately one-fourth inch wide and extends the full length of the lamp. A disadvantage with this starting aid is that the metal strip covers a relatively large percentage (approximately five percent) of the exterior surface of the glass envelope. The strip, therefore, absorbs or reflects approximately five percent of the light emitted by the lamp. Even though some of the light reflected by the metal strip is redistributed inside the lamp and is re-emitted, the total emission of the lamp is reduced by more than one to two percent. Another disadvantage is that the metal strip is visible at significant distances. A further disadvantage arises because the strip is usually manually attached to the lamp with an adhesive and an insulating cover to protect against electric shock. This manual process significantly increases the costs of manufacture.

Another starting aid disclosed in the prior art consists of a conductive coating, such as tin oxide, that is applied to the entire inside surface of the glass envelope. As with the opaque metal strip referred to above, a disadvantage with this starting aid is that it absorbs an important quantity (more than approximately one to two percent) of light emitted by the lamp. This is because the tin oxide covers essentially all of the interior surface area of the glass envelope. Another disadvantage is that the tin oxide coating creates potential concerns related to safety and lamp breakage during the manufacturing process. A further disadvantage from an environmental standpoint is that a corrosive agent is required to be used during the coating of the glass envelopes.

Yet another starting aid that is used is the metal luminaire into which the lamp is mounted. However, the proximity of the luminaire to the lamp electrodes is important in that case and the greater the separation, the less efficient is the starting aid. The present invention relaxes the requirements associated with the distance between the lamp electrodes and the metal luminaire and even enables the use of non-conducting (e.g. plastic) luminaires or even the elimination of the luminaire.

SUMMARY OF THE INVENTION

According to one aspect, the present invention concerns enabling lower wattage fluorescent lamps to start with a variety of ballasts by affixing to the exterior of the lamp a starting aid comprising a transparent electrically conductive material.

According to a further aspect, the present invention concerns a fluorescent lamp that comprises a glass envelope having an exterior surface, a first electrode and a second electrode located within the glass envelope and a transparent electrically conductive material affixed to the exterior surface of the glass envelope. The transparent electrically conductive material extends between the vicinity of the first electrode and the vicinity of the second electrode and provides a path for an electric current to pass between the first electrode and the second electrode so as to reduce the open circuit voltage required to start the fluorescent lamp. Since the path length for the electric current flow through a gaseous medium during ignition of the lamp for a lamp without a starting aid is the distance between the electrodes, the electrically conductive material provides a shorter path length. In the latter instance, the length of the path is the distance between the first electrode and its adjacent walls plus the distance between the second electrode and its adjacent walls. Additionally, the electrical current path through the transparent electrically conductive material has a very low impedance so as to reduce the open circuit voltage required to start the fluorescent lamp. According to a particular aspect, the impedance of the current path through the transparent electrically conductive material is controlled so as to fall below a specified value in order to reduce the open circuit voltage required to start the fluorescent lamp to a target level of approximately 300 volts or less.

According to another aspect, the transparent electrically conductive material comprises a transparent electrically conductive polymer or a transparent electrically conducting or semi-conducting material such as carbon nanotubes or tin oxide, for example. In a particular aspect, the electrically conductive material is a transparent electrically conductive polymer.

According to a further aspect, the open circuit voltage required to start the fluorescent lamp in the absence of the at least one stripe of the transparent electrically conductive material is at least about 400 volts.

According to still another aspect, the transparent electrically conductive material covers less than the total exterior surface area of the glass envelope.

According to yet another aspect, the transparent electrically conductive material comprises at least one stripe of the material that covers less than the total exterior surface area of glass envelope and extends between the vicinity of the first electrode and the vicinity of the second electrode.

According to yet another aspect, the at least one stripe of the transparent electrically conductive material comprises a first layer of the transparent electrically conductive material in engagement with the exterior surface of the glass envelope and one or more layers of transparent electrically conductive material that can be superimposed on top of the first layer of the transparent electrically conductive material. Alternatively, the additional layers can be applied adjacent the first layer of the electrically conductive material or elsewhere on the exterior of the glass envelope in order to further reduce the electrical impedance of the current path through the plurality of stripes and layers in order to reduce the open circuit voltage required to start the fluorescent lamp below about 300 volts or some other desired voltage level.

According to still a further aspect, the open circuit voltage required to start the fluorescent lamp increases as the electrical resistance of the transparent electrically conductive material increases over a range of resistances, with an abrupt increase in the open circuit voltage required to start the fluorescent lamp occurring over a portion of the range of resistances. The resistance of the transparent electrically conductive material affixed to the exterior surface of the glass envelope is equal to a resistance within that portion of the range of resistances. In a particular embodiment, the resistance of the electrically conductive material is approximately equal to that resistance at which the open circuit voltage required to start the fluorescent lamp begins to abruptly increase. In a particular embodiment that resistance is in the range of approximately 8,000 ohms to approximately 50,000 ohms and in a further particular embodiment the resistance is in the range of approximately 10,000 to approximately 20,000 ohms.

According to yet a further aspect, the at least one stripe of the transparent electrically conductive material comprises a coating of the transparent electrically conductive material that is applied to the exterior surface of the lamp.

BRIEF DESCRIPTION OF THE DRAWINGS

FIG. 3 is a cross-sectional view a fluorescent lamp according to another embodiment of the invention.

FIG. 4 is a plot of the relationship between the open circuit voltage and the electrical resistance of the transparent electrically conductive material applied to a fluorescent lamp in accordance with an embodiment of the invention.

DETAILED DESCRIPTION OF EMBODIMENTS OF THE INVENTION

In the description that follows, reference is made to the electrically conductive materials of the invention as comprising transparent electrically conductive materials. The word transparent is not used herein in a limited sense to mean that the electrically conductive materials are capable of transmitting light as if the electrically conductive material were not present, although the invention is broad enough to cover electrically conductive materials of that kind. Rather, the word transparent is used in the more general sense to indicate that the materials are capable of transmitting light to a significant degree such as would be the case, for example, when the transparent electrically conductive material absorbs less than approximately one to two percent of the light emitted by the fluorescent lamp as mentioned in paragraphs [0013] and [0014] above.

As noted above, according to one aspect, the present invention concerns a fluorescent lamp that comprises a glass envelope having an exterior surface together with a first electrode and a second electrode located within the glass envelope. Thus, in the embodiment of the invention shown in FIG. 1, there is illustrated generally at 1 a hermetically-sealed glass envelope in the form of a glass tube 2 that has an exterior surface, indicated generally at 4. A first electrode, indicated generally at 6, is located within the glass tube 2 at one end of the tube, and a second essentially similar electrode, not shown, is located within the glass tube 2 at the other end of the tube. The embodiment of the glass envelope of the fluorescent lamp shown in FIG. 1 comprises a glass tube, but the glass envelope can have other shapes and configurations such as, for example, oblate or spherical shapes.

Figure 1:
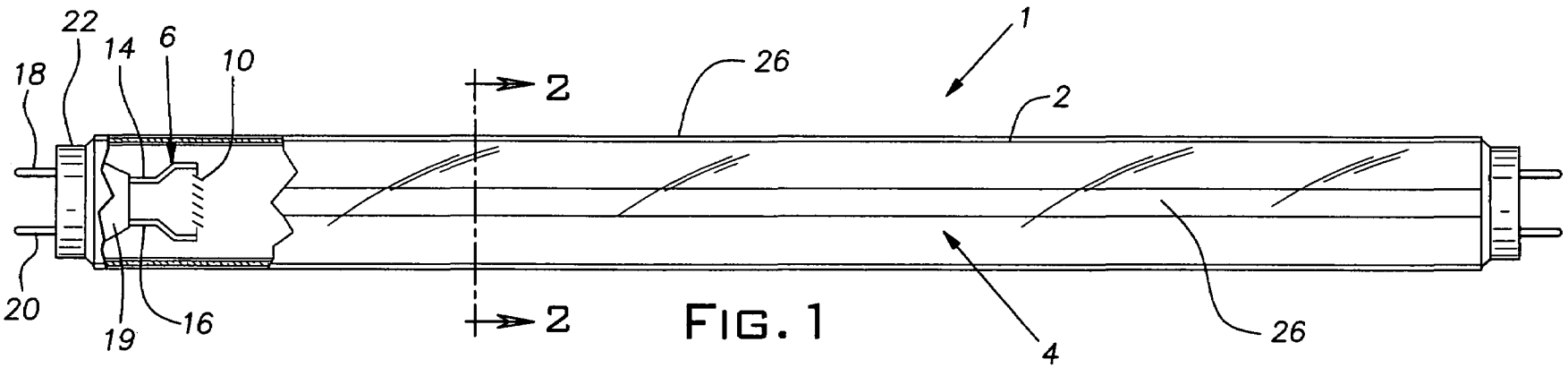
FIG. 1 is an elevational view of a fluorescent lamp partly broken away to show certain interior elements and components of one embodiment of the invention.

The electrode 6 includes a filament 10 that is formed from a material such as tungsten for example, with or without a coating of an alkaline-earth oxide, that will readily emit electrons when heated. The filament is electrically and mechanically connected to lead-in and support wires 14 and 16 that are hermetically sealed in the end portion 19 at the end of the glass tube 2. The support wires 14 and 16 are connected to the contact pins 18 and 20, respectively. A base cap 22 is located at each end of the glass tube and is attached to the glass tube by a suitable adhesive such as a bakelite cement for example. The structure of the electrodes and their arrangement in the glass envelope need not be as shown in FIG. 1, however, and can take other forms as will be understood by those having ordinary skill in the art.

Figure 2:
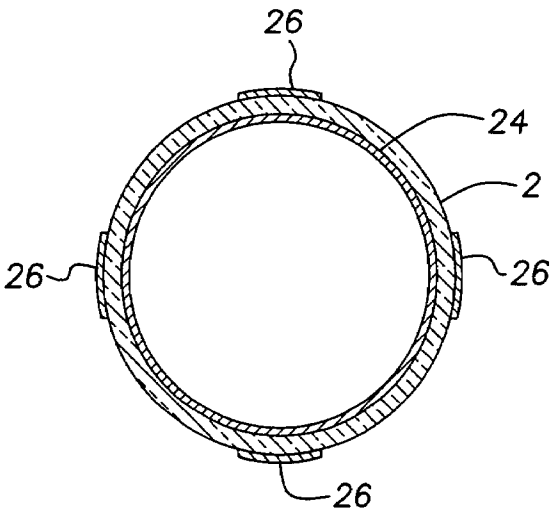
FIG. 2 is an enlarged cross-sectional view taken on line 2-2 of FIG. 1.

As shown in FIG. 2, a phosphor coating 24 such as calcium halophosphate, yttrium-europium oxide, lanthanum-cerium-terbium phosphate, strontium-europium choloroapatite, barium-europium magnesium aluminate or mixtures thereof, for example, is present on the interior surface of the glass tube 2. Also contained within the glass tube 2 is a gas such as argon, krypton, neon, xenon or mixtures thereof, for example, and a small amount of mercury.

In general, a transparent electrically conductive polymer is affixed to the exterior surface 4 of the glass envelope, the transparent electrically conductive polymer extending between the vicinity of the first electrode 6 and the vicinity of the second electrode and providing a path for an electric current to pass between the first electrode and the second electrode so as to reduce the open circuit voltage required to start the fluorescent lamp.

In the embodiment of the invention shown in the drawings, the fluorescent lamp includes at least one stripe 26 of a transparent electrically conductive material affixed to the exterior surface 4 of the glass envelope 2 and covering less than the total exterior surface area of the glass envelope. In particular, in the embodiment of the invention shown in FIGS. 1 and 2, the at least one stripe of the transparent electrically conductive material comprises four stripes 26 of the substantially transparent electrically conductive material. It is to be understood, however, that the present invention is not limited to the use of stripes of the transparent electrically conductive material or to the use of any particular number of stripes having any particular thickness or width. Thus, according to another embodiment of the invention, the transparent electrically conductive material can be applied uniformly over the entire exterior surface of the glass envelope. This embodiment of the invention is illustrated in FIG. 3 which is a cross-section of a lamp to which the transparent electrically conductive material has been applied uniformly over the entire exterior surface of the glass envelope. The important consideration in all cases is the resistance of the transparent electrically conductive material as applied to the glass envelope, as discussed in more detail below.

The at least one stripe 26 of substantially transparent electrically conductive material extends between the vicinity of the first electrode 6 and the vicinity of the second electrode and provides a path for an electric current to pass between the first electrode and the second electrode so as to reduce the open circuit voltage required to start the fluorescent lamp. The stripe does not have to be in contact with the electrodes in order to perform satisfactorily but the ends of the stripe do have to be in the vicinity of the electrode so as to provide a path for an electric current to pass between the two electrodes, whereby the electrons emitted from the electrode filaments can readily and quickly traverse the distance between the two electrodes. Typically, the ends of the stripe are spaced axially from the adjacent electrode by a distance approximately no greater than the diameter of the glass envelope.

Any type of transparent electrically conductive material that can withstand the environment in which the fluorescent lamp is being used and not adversely affect the operation of the fluorescent lamp can be employed. Examples of such a material are included in the group consisting of transparent electrically conductive polymers, and transparent electrically conducting or semi-conducting materials such as carbon nanotubes and tin oxide. Specific materials that can be used as the transparent electrically conductive polymer are the transparent conductive polymer products sold under the trade name BAYTRON and available from H.C. Starck Co.

The influence on lamp starting voltage of the transparent electrically conductive materials having varying impedances is shown in FIG. 4. The data in FIG. 4 were obtained by first applying to the exterior of a glass envelope stripes of a transparent electrically conductive polymer of the type described above and having different thicknesses and geometries. The stripes on the fluorescent lamps that were employed to obtain the data set forth in FIG. 4 were applied to the exterior surfaces of the glass envelopes of the lamps in the form of a coating of the transparent electrically conductive polymer by spraying the polymer onto the exterior surfaces of the glass envelopes. Before the lamps were assembled, the glass envelopes of the lamps were mounted horizontally in a fixed position and the polymer was applied by means of a spray gun mounted on a track that was located lengthwise along the glass envelopes. As the spray gun was uniformly advanced along the track, the polymer was sprayed onto the exterior surfaces of the glass envelopes. Two passes with the spray gun were made for each stripe so that, when the stripe was completed, it comprised a first layer of the transparent electrically conductive material in engagement with the exterior surface of the glass envelope and a second layer of the transparent electrically conductive material superimposed on the first layer of the transparent electrically conductive material. Applying the stripe in two layers in this fashion can enhance the conductivity of the stripe. However, a suitably conductive stripe can be produced by applying a single layer of the transparent electrically conductive polymer.

After the transparent electrically conductive polymer were applied, both the open circuit voltages and the end-to-end impedances of the stripes were measured. The open circuit voltages were measured using a standard oscilloscope in circuit with a reference lamp and a variable power supply while the end-to-end impedances were measured using special surface-to-surface paddle probes designed to function with a standard Digital Multi-meter.

It is, of course, desirable to minimize the interference the stripes have on the transmission of light through the glass envelope. For that reason, it is desirable to maintain the thickness and width of the stripes to a minimum consistent with the requirement that the stripes be sufficiently thick and wide to adequately serve as an electrically conductive path. FIG. 4 presents data that is relevant to that consideration. Specifically, as indicated in FIG. 4, as the resistance of a stripe of the polymer applied to a fluorescent lamp decreases, indicating an associated increase in the conductivity of the stripe, the open circuit or starting voltage of the fluorescent lamp decreases. However, increased conductivity results from increasing the thickness and/or width of the polymer stripe, which, in turn, increases the interference with the transmission of light from the lamps.

Based on the foregoing, and referring specifically to FIG. 4, it will be understood that the open circuit voltage required to start the lamp increases as the resistance of the at least one stripe of the electrically conductive material decreases over a range of thicknesses. Additionally, there is an abrupt increase in the open circuit voltage over a portion of the range of thicknesses, as delineated by the dotted lines A-A and B-B in FIG. 4. In a particular embodiment of the invention, the resistance of the at least one stripe of the electrically conductive material affixed to the exterior of the glass envelope is equal to the resistance within the portion of the range of resistances delineated by the dotted lines A-A and B-B. In the embodiment of the invention shown in FIG. 4, the range of thicknesses delineated by the dotted lines A-A and B-B is approximately 8,000 ohms to approximately 50,000 ohms.

It can be seen from FIG. 4 that the electrical resistance required to provide a fluorescent lamp with an ignition voltage of approximately 300 volts, so as to enable the lamp to transition to arc when used with rapid-start and programmed-start ballasts, is approximately 20,000 ohms for the embodiment of the invention on which FIG. 4 is based. And as discussed above, the thickness of the transparent electrically conductive material applied to the glass envelope, and where the conductive material is applied in stripes, the width of the stripes, determines the electrical resistance of the conductive material. Consequently, in a particular embodiment of the invention, the transparent electrically conductive material is applied so that its resistance will be approximately 20,000 ohms. Further reductions in the ignition voltage are possible by applying sufficient transparent electrically conductive material so as to decrease the resistance to about 10,000 ohms. It will be appreciated that because the electrically conductive material is transparent, as that term is defined above, and because the material can be present in the form of one or more stripes of a width and thickness that, while providing the desired electrical resistance, are only a few millimeters wide, the absorption of the light generated by the lamp is minimized. Typically, the light loss from the lamp when the present invention is employed is less than the light loss resulting from the use of an opaque metal stripe on the outside of the glass envelope or a coating of tin oxide over the entire inner surface of the glass envelope. Furthermore, the visual appearance of the relatively narrow width of the stripes of the electrically conductive material is much less obvious.

Although the width of the stripe is not critical for the purpose of maximizing the coupling of the current from the fluorescent lamp electrodes during ignition of the lamp, the width of the stripe can be maximized while the thickness of the strip is minimized in order that a minimum of light be absorbed, while the electrical resistance of the stripe is maintained below approximately 20,000 ohms. Of course, the thickness of the stripe must be great enough to avoid breaking the electrical continuity of the conductive stripe so that the stripe will serve satisfactorily as an electrical conductor between the two electrodes. Additionally, it is possible to achieve the desired electrical resistance by applying the electrically conductive material uniformly over the entire exterior surface of the glass envelope in a manner described with reference to FIG. 3 and in a thinner layer than that required using stripes so that the coating is essentially not visible but still provides the desired reduction in ignition voltage while absorbing a minimum of light.

As previously noted, the present invention can be employed with watt-miser fluorescent lamps so that the lamps can be used with both rapid-start and instant-start ballasts. In currently available watt-miser lamps, the open circuit voltage required to start the lamp in the absence of the at least one stripe of the transparent electrically conductive material is at least about 400 volts. Based on the data from FIG. 4, at least one stripe of electrically conductive material is sufficient to allow the watt-miser lamps to be used with rapid-start and instant-start ballasts if the electrical resistance of the at least one stripe is not greater than about 50,000 ohms.

Although particular embodiments of the invention have been described, it will be apparent to those skilled in the art that various modifications can be made without departing from the spirit and scope of the invention as set forth in the claims.

What is claimed is:

1. A fluorescent lamp comprising:

a glass envelope having an exterior surface;

a first electrode and a second electrode located within the glass envelope;

and a transparent electrically conductive material affixed to the exterior surface of the glass envelope, the transparent electrically conductive material extending between the vicinity of the first electrode and the vicinity of the second electrode and providing a path for an electric current to pass between the first electrode and the second electrode so as to reduce the open circuit voltage required to start the fluorescent lamp, and wherein the transparent electrically conductive material absorbs less than approximately two percent of the light emitted by the fluorescent lamp.

2. The fluorescent lamp of claim 1 wherein the transparent electrically conductive material comprises at least one stripe of the transparent electrically conductive material that covers less than the entire exterior surface of the glass envelope.

3. The fluorescent lamp of claim 2 wherein the transparent electrically conductive material is selected from the group consisting of transparent conductive polymers, carbon nanotubes and tin oxide.

4. The fluorescent lamp of claim 3 wherein the transparent electrically conductive material is a transparent electrically conductive polymer.

5. The fluorescent lamp of claim 2 wherein the open circuit voltage required to start the fluorescent lamp in the absence of the transparent electrically conductive material is at least approximately 400 volts.

6. The fluorescent lamp of claim 2 wherein the open circuit voltage required to start the fluorescent lamp increases as the electrical resistance of the transparent electrically conductive material increases over a range of resistances, with there being an abrupt increase in the open circuit voltage required to start the fluorescent lamp over a portion of the range of resistances, and the resistance of the transparent electrically conductive material affixed to the exterior surface of the glass envelope is equal to a resistance within the portion of the range of resistances.

7. The fluorescent lamp of claim 6 wherein the portion of the range of resistances extends from approximately 8,000 ohms to approximately 50,000 ohms.

8. The fluorescent lamp of claim 7 wherein the resistance of the transparent electrically conductive material is in the range of approximately 10,000 ohms to approximately 20,000 ohms.

9. The fluorescent lamp of claim 3 wherein the resistance of the transparent electrically conductive material is less than approximately 20,000 ohms.

10. The fluorescent lamp of claim 2 wherein the transparent electrically conductive material comprises a coating of the transparent electrically conductive material.

11. The fluorescent lamp of claim 1 wherein the transparent electrically conductive material is selected from the group consisting of transparent electrically conductive polymers, carbon nanotubes and tin oxide.

12. The fluorescent lamp of claim 11 wherein the transparent electrically conductive material is a transparent electrically conductive polymer.

13. The fluorescent lamp of claim 12 wherein the open circuit voltage required to start the fluorescent lamp in the absence of the transparent electrically conductive material is at least approximately 400 volts.

14. The fluorescent lamp of claim 12 wherein the open circuit voltage required to start the fluorescent lamp increases as the electrical resistance of the transparent electrically conductive material increases over a range of resistances, with there being an abrupt increase in the open circuit voltage required to start the fluorescent lamp over a portion of the range of resistances, and the resistance of the transparent electrically conductive material affixed to the exterior surface of the glass envelope is equal to a resistance within the portion of the range of resistances.

15. The fluorescent lamp of claim 14 wherein the open circuit voltage required to start the fluorescent lamp in the absence of the transparent electrically conductive material is at least approximately 400 volts.

16. The fluorescent lamp of claim 1 wherein the open circuit voltage required to start the fluorescent lamp in the absence of the transparent electrically conductive material is at least approximately 400 volts.

17. The fluorescent lamp of claim 1 wherein the open circuit voltage required to start the fluorescent lamp increases as the electrical resistance of the transparent electrically conductive material increases over a range of resistances, with there being an abrupt increase in the open circuit voltage required to start the fluorescent lamp over a portion of the range of resistances, and the resistance of the transparent electrically conductive material affixed to the exterior surface of the glass envelope is equal to a resistance within the portion of the range of resistances.

18. The fluorescent lamp of claim 17 wherein the portion of the range of resistances extends from approximately 8,000 ohms to approximately 50,000 ohms.

19. The fluorescent lamp of claim 18 wherein the resistance of the transparent electrically conductive material is in the range of approximately 10,000 ohms to approximately 20,000 ohms.

20. The fluorescent lamp of claim 19 wherein the resistance of the transparent electrically conductive material is less than approximately 20,000 ohms.

21. The fluorescent lamp of claim 1 wherein the transparent electrically conductive material comprises a coating of the transparent electrically conductive material.

22. A fluorescent lamp comprising:

a glass envelope having an exterior surface;

a first electrode and a second electrode located within the glass envelope; and a transparent electrically conductive material affixed to the exterior surface of the glass envelope, the transparent electrically conductive material extending between the vicinity of the first electrode and the vicinity of the second electrode and providing a path for an electric current to pass between the first electrode and the second electrode so as to reduce the open circuit voltage required to start the fluorescent lamp; and wherein the open circuit voltage required to start the fluorescent lamp increases as the electrical resistance of the transparent electrically conductive material increases over a range of resistances, with there being an abrupt increase in the open circuit voltage required to start the fluorescent lamp over a portion of the range of resistances, and the resistance of the transparent electrically conductive material affixed to the exterior surface of the glass envelope is equal to a resistance within the portion of the range of resistances.

* * * * *